US008727915B2

(12) United States Patent
Lignelli et al.

(10) Patent No.: US 8,727,915 B2
(45) Date of Patent: May 20, 2014

(54) HANDLE-DAMPENING LACROSSE STICK

(75) Inventors: Joanna Lignelli, Baltimore, MD (US); Anthony Abdelmalek, Baltimore, MD (US)

(73) Assignee: WM. T. Burnett IP, LLP, Baltimore, MD (US)

( * ) Notice: Subject to any disclaimer, the term of this patent is extended or adjusted under 35 U.S.C. 154(b) by 328 days.

(21) Appl. No.: 13/267,537

(22) Filed: Oct. 6, 2011

(65) Prior Publication Data

US 2012/0264551 A1 Oct. 18, 2012

Related U.S. Application Data

(60) Provisional application No. 61/390,339, filed on Oct. 6, 2010.

(51) Int. Cl.
*A63B 59/02* (2006.01)
*A63B 65/12* (2006.01)

(52) U.S. Cl.
USPC ..... 473/513; D21/724

(58) Field of Classification Search
USPC ..... 473/505, 513; D21/724
See application file for complete search history.

(56) References Cited

U.S. PATENT DOCUMENTS

| | | | | | |
|---|---|---|---|---|---|
| 648,256 | A * | 4/1900 | Hartley | ..... | 473/307 |
| 1,428,015 | A * | 9/1922 | Dienner | ..... | 473/232 |
| 3,545,737 | A * | 12/1970 | Lamprey et al. | ..... | 267/141 |
| 4,052,060 | A * | 10/1977 | Balkcom | ..... | 473/531 |
| 5,178,387 | A * | 1/1993 | Kuebler | ..... | 473/523 |
| 7,282,000 | B2 * | 10/2007 | Brine et al. | ..... | 473/513 |
| 7,393,294 | B2 * | 7/2008 | Filice et al. | ..... | 473/513 |
| 7,407,456 | B2 * | 8/2008 | Price et al. | ..... | 473/513 |
| 2012/0264551 | A1 * | 10/2012 | Lignelli et al. | ..... | 473/513 |

* cited by examiner

*Primary Examiner* — Alvin Hunter
*Assistant Examiner* — M Chambers
(74) *Attorney, Agent, or Firm* — Ober, Kaler, Grimes & Shriver; Royal W. Craig

(57) ABSTRACT

A lacrosse stick for reducing the rebound of a ball caught therein. The head of the lacrosse stick is affixed to a tubular shaft in which a portion of the shaft wall at the top end is omitted on the front side and another portion is omitted on the backside below the first omitted portion. A resilient member is inserted within the shaft extending past the lower omitted portion of the shaft wall. The resilient member fills the omitted areas to seat flush therein. A head having a socket and throat is affixed to top end of the shaft. The socket engages the resilient insert via the omitted portions. When a force is applied, for example, by a ball caught in the pocket, the socket compresses the resilient member from the front and the throat from the back allowing the head to rotate backward, dissipating some of the energy and reducing rebound.

20 Claims, 5 Drawing Sheets

HANDLE-DAMPENING LACROSSE STICK

CROSS-REFERENCE TO RELATED APPLICATIONS

The present application claims priority to U.S. provisional patent application Ser. No. 61/390,339 filed Oct. 6, 2010 which is incorporated herein by reference.

BACKGROUND OF THE INVENTION

1. Field of the Invention

The present invention relates generally to lacrosse sticks, and more particularly to an apparatus and method for dampening the rebound of a lacrosse stick head pocket after the pocket has had force applied to it by, for example, a caught lacrosse ball.

2. Description of the Background

FIG. 1 illustrates a conventional molded-head lacrosse stick. As shown, a typical lacrosse stick includes a handle or shaft 20 (dashed lines) and a double-wall synthetic head 10. Head 10 includes a generally V-shaped frame having two sidewalls 14A, 14B joined by a stop member 18 at the end narrow end of the "V," nearest the shaft 20. A transverse wall (or "scoop") 16 joins the sidewalls 14A, 14B at the open end of the "V." Webbing is woven between the sidewalls, scoop and stop member to form a pocket as will be described. The "double-wall" descriptor applied to the head 10 refers to the fact that it has two sidewalls as opposed to the single sidewall found in traditional wooden lacrosse sticks in which the pocket is completed by a woven gut wall in place of a second, wooden sidewall. The shaft 20 joins the narrow end of the head and is received in a socket formed in the stop member 18. The shaft 20 passes through a throat 12 before being received in the stop member 18, the throat 12 being supported by extensions of the sidewalls. A screw or other fastener 22 placed through stop member secures shaft 20 to head 10. The traditional double-wall head 10 is a monolithic structure that is injection-molded from synthetic materials such as nylon, urethane and polycarbonate which are known in the art.

The head of a lacrosse stick is strung in one of several ways with a series of strings and/or mesh to form a pocket for catching and throwing the lacrosse ball. Traditionally-strung pockets are required by the rules of the women's game and have four or five longitudinal leather and/or synthetic thongs, eight to twelve stitches of lateral cross-lacing and no more than two "shooting/throw" strings. To facilitate stringing of the thongs, a series of upper thong holes 32 are provided in transverse wall 16 and paired with corresponding thong holes 34 in stop member 18. To complete the pocket web nylon strings are woven around the thongs and laced through string holes 36 in sidewalls 14A and one or more throwing or shooting strings are woven through the thongs extending transversely between the throwing string holes 38 on the upper portions of sidewalls 14A, 14B. These typical features of a lacrosse stick are all shown generally in Tucker et al., U.S. Pat. No. 3,507,495; Crawford et al., U.S. Pat. No. 4,034,984; and Tucker et al., U.S. Pat. No. 5,566,947, which are each incorporated by reference herein. In order to comply with the rules of the women's game, the pocket must be strung such that the top of a lacrosse ball (2.5 inches in diameter) placed in the pocket held horizontally extends above the top edge of the side walls 14A, 14B. The rules of the men's game allow traditional stringing but also permit mesh pockets that are significantly deeper and more forgiving. The pocket of a men's stick must be strung so that the top of a lacrosse ball placed in the pocket extends above the bottom edge of the side walls 14A, 14B.

Although the synthetic materials used in the construction of the head impart many performance advantages over traditional wooden heads, the synthetic, monolithic double-wall head fails to outperform the wooden heads in one critical aspect: pocket "give." Specifically, whereas traditional unitary single walled wooden and gut sticks deflected under the force of a caught ball, the strength and rigidity of synthetics required for head durability combined with the rigid metal shaft is at odds with the desire for the pocket to "give" in order to facilitate catching the heavy, hard rubber lacrosse ball. Because the synthetic heads use substantially rigid materials to provide the structural integrity and durability of the head frame, the thong holes in the substantially rigid head provide little deflection against which the pocket strings can pull or stretch. In other words, the thong holes in a synthetic head do not deaden the tension of the pocket webbing, as occurs, for example, when a lacrosse ball hits the pocket. Similarly, the rigid connection between the head and the unyielding shaft provides no deadening or absorption of the force of the ball.

Notably, this pocket "give" is most critical in the women's game in which shallow pocket depth rules necessitate tightly strung pockets. As a result of the necessary tension, when a lacrosse ball hits the pocket the impact forces are returned to the ball, producing a rebounding or trampoline effect that can propel the ball out of the pocket. This makes it difficult to catch and control thrown balls, particularly balls thrown at high velocity. Indeed, for all but the most skilled players, a lacrosse ball can easily bounce out of a rebounding pocket. In essence, the pocket, strung on a rigid unforgiving frame, acts like the strings of a tennis racquet and rebounds the ball out of the pocket. Although this trampoline effect is more pronounced in the tightly strung women's lacrosse heads, the desire to absorb the impact of an incoming ball is equally applicable to men's lacrosse heads. Thus, there remains a need for a synthetic lacrosse head design that provides the pocket "give" of a traditional wooden head while maintaining the light weight, durability, and structural integrity of synthetic lacrosse heads.

SUMMARY OF THE INVENTION

It is, therefore, an object of the present invention to provide a method and apparatus for dampening the rebound of a lacrosse head pocket after the pocket has had force applied to it by, for example, a thrown lacrosse ball.

Unlike the substantially rigid lacrosse head frames of the prior art, which attach pocket thread to unforgiving, rigid structures, the present invention provides a flexible energy-absorbing material within or as part of the handle where the rigid head and handle meet. The material within or attached to the handle is part of an otherwise rigid handle. The flexibility of the material produces a "give" that minimizes the rebound of a pocket after being impacted by a ball. This pocket dampening limits the movement of the ball and makes the ball easier to control and to retain in the pocket. The precise location of the dampening material on the lacrosse handle may be varied to control the degree of pocket "give" in response to, for example, the force on the pocket created by a ball impacting the pocket during a catch or swinging in the pocket during cradling.

The head of the lacrosse stick is affixed to the top end of a tubular shaft in which a portion of the shaft wall at the top end of the shaft is omitted on the front side of said shaft and a portion of the shaft wall is omitted on the a back side of said shaft below the first omitted portion. A resilient member is inserted within the tubular member extending longitudinally at least to or slightly past the lower omitted portion of the shaft wall, the resilient member being contoured to fill the areas of omitted shaft wall so as to be flush with the outside surface of the shaft. A head having a socket for receiving the shaft is affixed to the top end of the shaft. A throat is aligned with the socket such that the shaft passes through or by the throat when received in said socket. The socket engages the resilient insert via the omitted portion on the front side of the shaft wall while the throat engages the resilient insert via omitted portion on the back side of the shaft wall when said top end of said shaft is seated in the socket. When a force is applied to the front side of the head by, for example, a ball being caught in the pocket, the socket compresses the resilient member from the front while the throat compresses the resilient member from the back allowing the head to rotate backward about an axis perpendicular to the shaft and thereby dissipate some of the energy of the thrown ball rather than returning that energy to the ball.

BRIEF DESCRIPTION OF THE DRAWINGS

Other objects, features, and advantages of the present invention will become more apparent from the following detailed description of the preferred embodiments and certain modifications thereof when taken together with the accompanying drawings in which.

DETAILED DESCRIPTION OF THE PREFERRED EMBODIMENT

Figure 1:
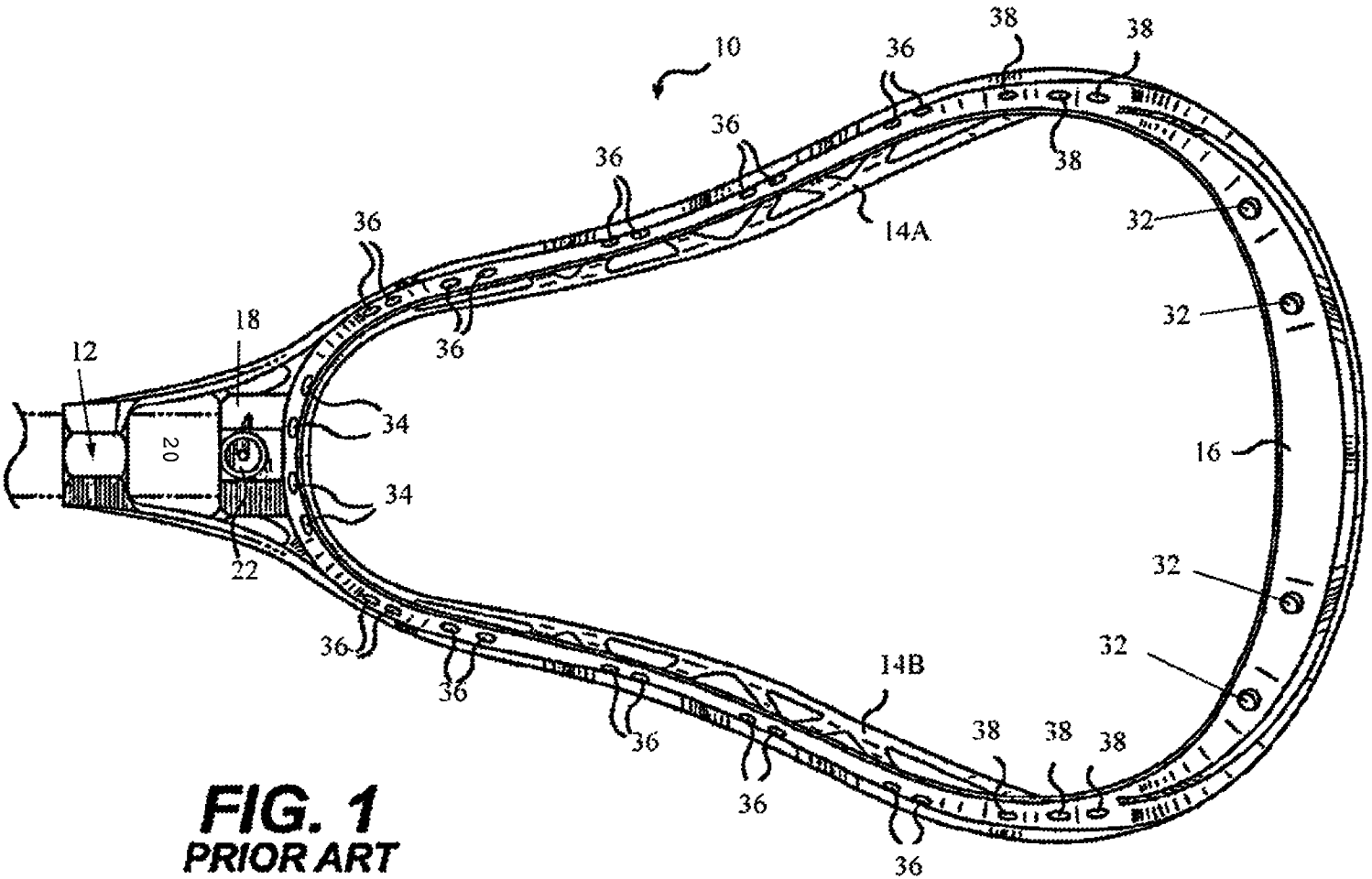
FIG. 1 PRIOR ART
FIG. 1 is a front perspective view of a conventional (prior art) molded-head lacrosse stick
Figure 2:
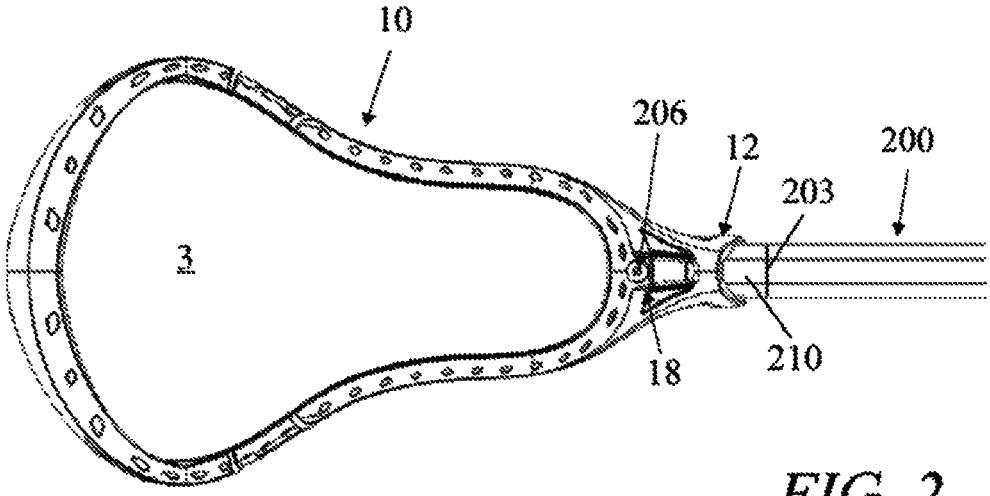
FIG. 2 is a bottom view of an exemplary embodiment of the present invention.
Figure 3:
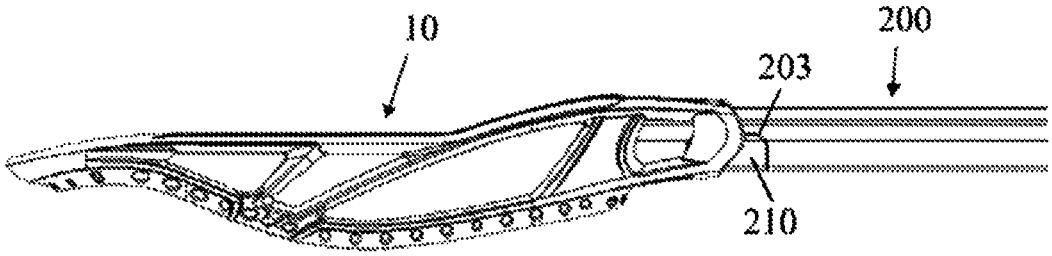
FIG. 3 is a side view of an exemplary embodiment of the present invention.

The present invention is an apparatus and method for dampening the rebound of a lacrosse head after the head has had force applied to it by, for example, a lacrosse ball being caught in its pocket. FIG. 2 is a bottom perspective view and FIG. 3 is a side view of an exemplary embodiment of the present invention, which generally includes a lacrosse head 10 defining a pocket 3 and a hollow lacrosse handle or shaft 200 extending from the head as described above. The shaft is received in a throat as will be described and is typically of a hollow, rounded hexagonal, octagonal, oval or circular cross section and made of metal or composite materials. The top end of the shaft (where the shaft meets the head) is shaped and contoured to receive a resilient insert 210 therein to achieve the purposes of the invention as will also be described. It should be noted that the relatives terms such as "top," "bottom," "front" and "back" are used herein to describe the invention as depicted in the accompanying figures are not intended to be limiting. It will be apparent to skilled practitioners that the orientation of a lacrosse stick varies wildly during play and the relative position of the elements of the present invention will similarly vary from those depicted.

Figure 8:
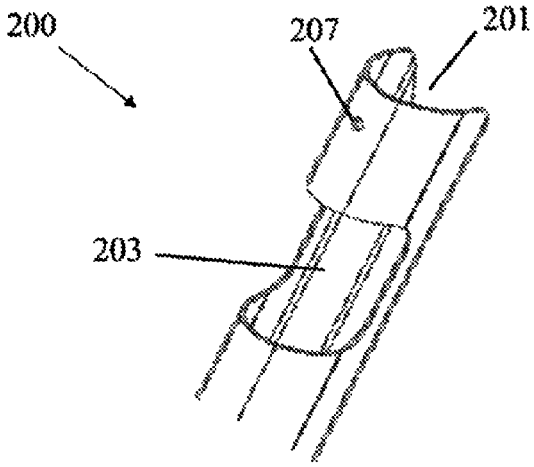
FIG. 8 is a three-quarters back perspective view of a shaft according to an exemplary embodiment of the present invention.
Figure 12A:
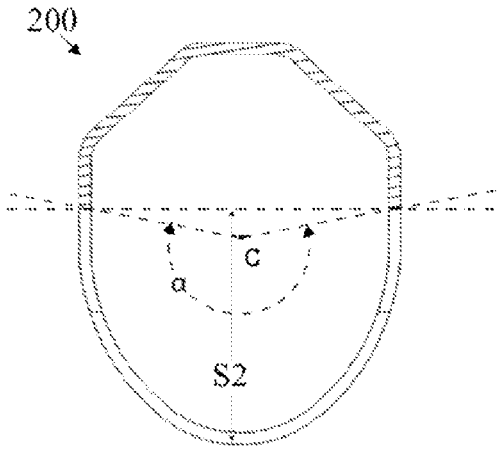
FIGS. 12*a* and 12*b* are sectional views through the shaft at the notch with and without the resilient insert in place.
Figure 12B:
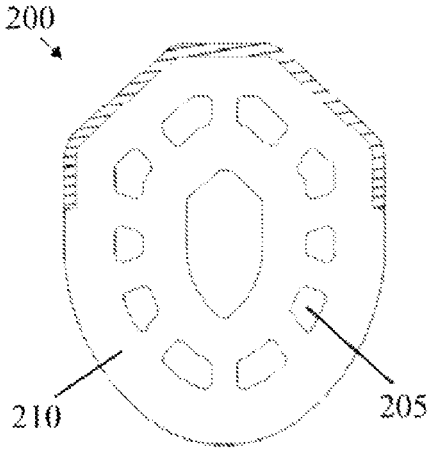

FIG. 8 is a partial perspective detail view of the top end of the shaft 200 from the back. As can be seen from the figure, a portion of the tubular shaft wall on the back side of the shaft 200 is removed or omitted beginning preferably at approximately from ¾ to 1¼ inches (10 to 30 mm) along the length of the shaft and continuing longitudinally for approximately another 1½ to 2 inches (35 mm to 50 mm) therefrom to create a "notch" 203 in the shaft 200. With reference to FIGS. 12*a*, 12*b*, cross-sectionally, the arc of the area of removed material forming the notch is preferably symmetrically positioned along the center line of the back side of the shaft and includes a sufficient angle such that the sagitta $S_2$ of the chord of the defined segment is of greater dimension than the anticipated deflection of the throat 12 under load of a caught lacrosse ball so as to prevent the distal portion of the throat 12 from directly engaging the shaft walls at the back of the shaft. This dimension will largely be a function of the material properties of the elastomeric insert 210 as will be described. The subtended angle $\alpha$ of the arc of the removed portion 203 of shaft wall material is preferably from 80-degrees to 190-degrees.

Figure 9:
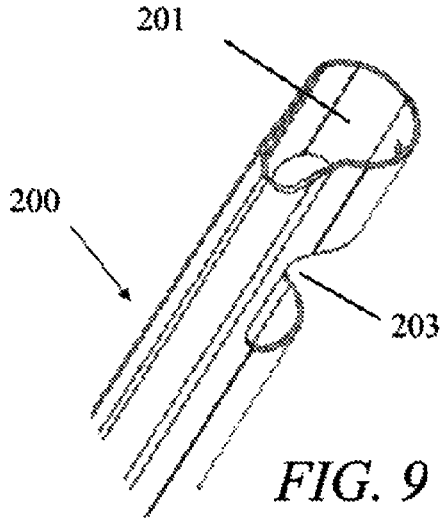
FIG. 9 is a three-quarters front perspective view of a shaft according to an exemplary embodiment of the present invention.
Figure 13A:
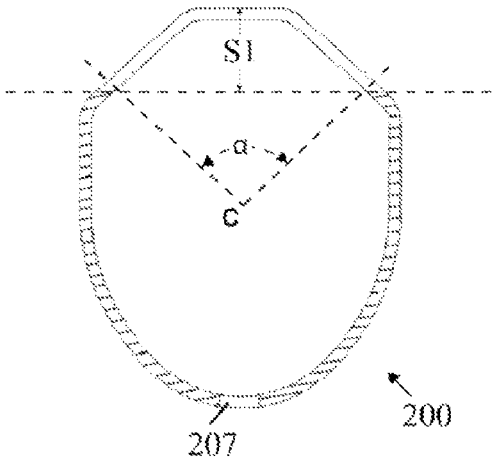
FIGS. 13*a* and 13*b* are sectional views through the shaft at the screw hole with and without the resilient insert in place.
Figure 13B:
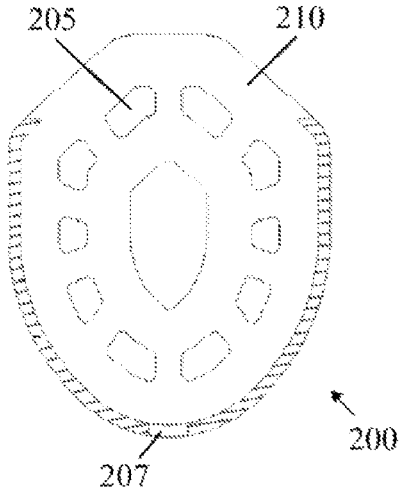

FIG. 9 is a partial perspective detail view of the top end of the shaft 200 from the front. As can likewise be seen from FIG. 9, material is also removed from the front portion of the tubular shaft wall. The area 201 of removed or omitted shaft wall preferably extends longitudinally from the top end of the shaft 20 to a point ¾ to 1 inch (20 mm to 25 mm) down the length of the shaft 200. With reference to FIGS. 13*a*, 13*b*, cross-sectionally, the area 201 of removed or omitted shaft wall and is open to the end of the shaft. However, open area 201 need not necessarily continue to and be open to the top end of the shaft. The arc of the area of removed material is preferably symmetrically positioned along the center line of the front side of the shaft (diametrically opposed to the front side) and includes a sufficient angle such that the sagitta $S_1$ of the chord of the defined segment is of greater dimension than the anticipated deflection of the throat 12 under load of a caught lacrosse ball so that the portion of the throat 12 adjacent to the stop member 18 (FIG. 2) does not directly engage the shaft walls at the front of the shaft 200. This dimension will also be a function of the material properties of the elastomeric insert material 210. The subtended angle $\alpha$ of the arc of the area 201 of removed material is preferably from 80-degrees to 180-degrees. It is permissible that the area 201 of removed shaft wall overlap longitudinally on the shaft 20 with the notch 203. The area 201 of removed or omitted shaft wall may be tapered longitudinally where the areas of removed material 201 is adjacent to or overlaps with the notch 203 so that the areas do not intersect and there is sufficient shaft wall remaining to maintain the structural integrity of the shaft.

Figure 10:
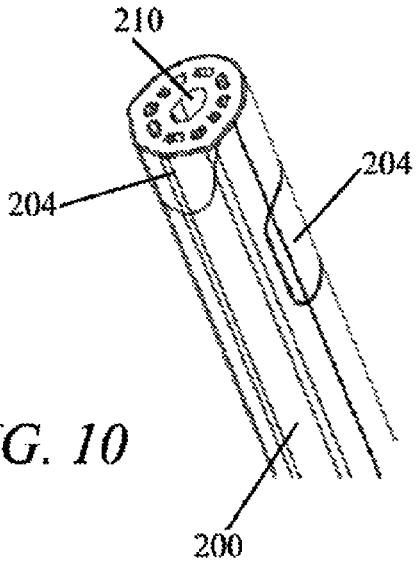
FIG. 10 is a three-quarters front perspective view of a shaft and resilient insert according to an exemplary embodiment of the present invention.
Figure 11:
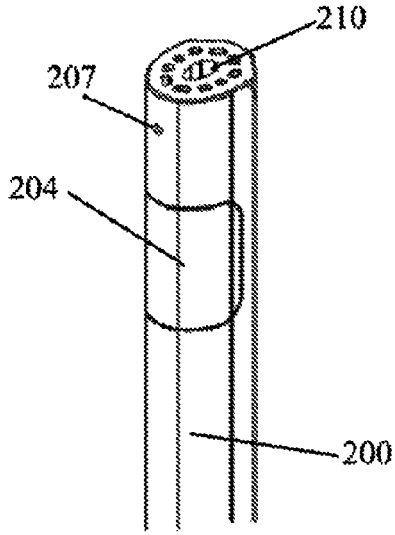
FIG. 11 is a three-quarters back perspective view of a shaft and resilient insert according to an exemplary embodiment of the present invention.

With reference to FIGS. 5-7, 10 and 11, an insert 210 of resilient material, more resilient than that of the shaft walls, is inserted into the hollow shaft 200. The insert 210 is provided in overall size and shape to closely fill the internal void of the shaft 200 and extend down the shaft past the distal end of the notch, as seen in FIG. 3 in which the distal end 221 of the insert 210 is visible. The insert 210 preferably extends past the distal end of the notch 203 a distance sufficient that the end condition of the insert 210 does not interact with or influence compression of the insert 210 during use. Preferably, the insert 210 extends at least ⅜ inch (10 mm) past the distal end of the notch 203. The surface of the insert 210 is preferably raised or contoured in areas 204 to account for the shaft wall thickness in the areas in which material has been removed or omitted 201, 203 such that the outside surface of the insert 210 seats flush with the outside surface of the shaft 200 as seen in FIGS. 10 and 11. At the top end of the shaft 200, the end of the insert 210 is flush with or just proud of the end of the shaft.

The insert 210 may comprise an elastomeric, flexible material in a generally cylindrical or other suitable shape (hexagonal, octagonal, oval, etc.) to conform to the interior shape of the shaft as described. The durometer hardness of the elastomeric material of the insert 210 can be selected from 20-95 A (ASTM D2240 type A durometer scale) to increase or decrease the relative amount of flexibility and "give" achieved by the overall assembly. A durometer hardness of from 35-50 A is preferred. The insert 210 may be of solid construction or may have on or more voids 205 or other perforations to control (increase) the degree of head flex or "give" as well as the overall weight of the lacrosse stick. An otherwise solid insert 210 may be provided with partial or complete vertical or horizontal holes or voids 205 to control weight and head flexibility and allow flexibility or forgiveness to be built in at different locations along the length of the shaft 200.

The insert 210 may also comprise multiple discrete elements of differing materials having differing hardness or elasticity characteristics to tailor the feel of the stick. For example, one or more longitudinal voids 205 may be filled with a second resilient material (not shown) of a differing hardness value from that of the material of the insert itself such that overall resilient property of the insert 210 are modified. The second resilient material may be of greater or lesser hardness or resilience as compared to that of the inset 210 and may run the entire length of void 205 or may run only a portion of that length such that the resilient characteristics of the insert 210 vary along the length of the shaft. Similarly, insert 210 may itself be comprised of two or more regions or pieces of resilient material to create an insert having varying resilient properties at one end as compared to another. The two pieces of such a resilient member may be mechanically joined or unitarily formed to create a single insert 210 or may be separately inserted into and retained in the shaft 200 in alignment with the areas in which material has been removed or omitted 201, 203 from the shaft wall.

Figure 4:
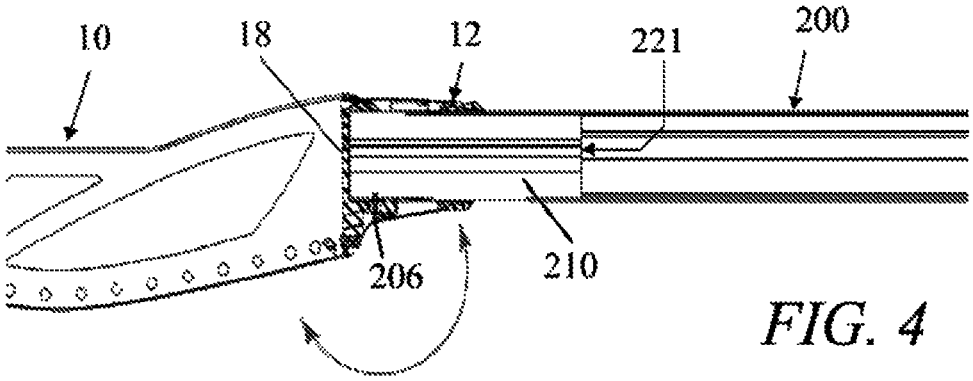
FIG. 4 is a longitudinal section of an exemplary embodiment of the present invention.
Figure 5:
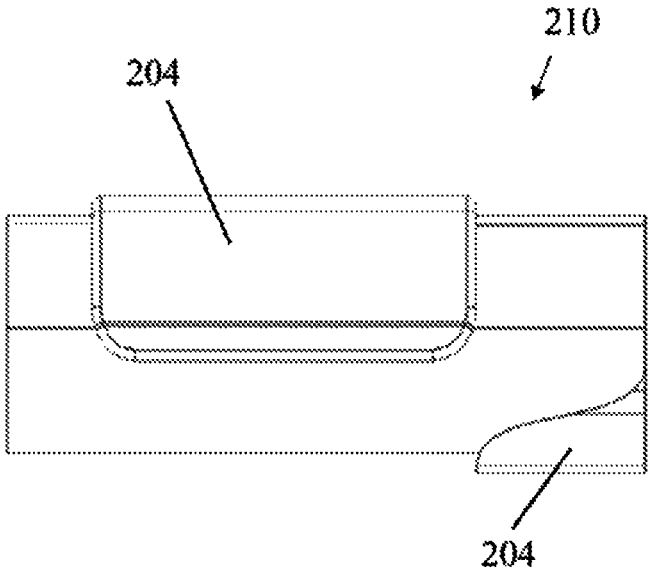
FIG. 5 is a side view of a resilient insert of an exemplary embodiment of the present invention.
Figure 6:
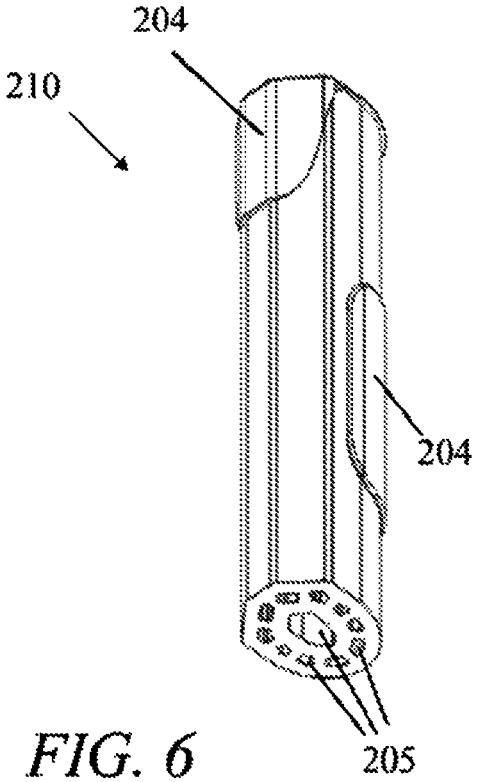
FIG. 6 is a three-quarters front perspective view of a resilient insert according to an exemplary embodiment of the present invention from below.
Figure 7:
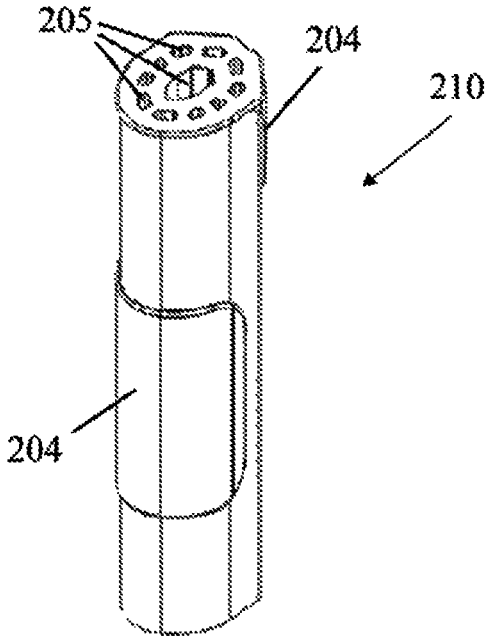
FIG. 7 is a three-quarters back perspective view of a resilient insert according to an exemplary embodiment of the present invention from above.

With reference to FIGS. 2 through 4, the rigid lacrosse head 10 is affixed to the shaft 200 by inserting the shaft through the throat 12 and into the socket of the stop member 18, as shown. The throat 12 is preferably formed as a ring cooperatively shaped to engage and tightly encircle the exterior surface of the inserted shaft 200. Similarly, the socket of the stop member 18 is preferably formed as a ring cooperatively shaped to engage and tightly encircle the exterior surface of the inserted shaft 200, however, in certain embodiments both the throat and the socket may only partially encircle the shaft at, for example the back or front of the shaft. Although aligned with the socket such that the shaft will necessarily pass through the throat when inserted into the socket, the throat 12 is preferably a separate element from the socket and is spaced longitudinally a distance down the length of the shaft from the socket such that the socket and shaft engage the shaft in two discrete and discontinuous regions. It is preferred that no contact be made between the head and the shaft in the region between socket and throat to so as not to impede rotation as will be described. The throat 12 is preferably supported by the sidewalls 14*a*, 14*b* in order to create the desired separation from the socket. The space between the socket and throat is, however, not critical and may, in certain embodiments, be omitted such that the socket and throat are of unitary construction.

With the top of the shaft 200 fully inserted and seated in the socket of the stop member 18, the distal throat 12 will be aligned with the notch 203 such that the inside surface of the throat engages only the insert 210 at the back of the shaft where the insert is accessible through the notch 203. Similarly, with the shaft fully inserted and seated, the socket of the stop member 18 is aligned with the area 201 of removed material on the front of the shaft 200 such that the inside surface of socket engages only the insert 201 at the front of the shaft. A screw 206 or similar means of attachment is inserted through the back of the socket 18 and into a hole 207 in the back of the shaft to secure the head to the shaft.

In use, when force is applied to the head 10 such as from a thrown lacrosse ball received in the pocket from the front, the head 10 will rotate backwards by pushing into and compressing the resilient insert 210 inside the shaft 200 to dissipate some of the energy of the moving ball and allow for a softer, more forgiving catch of the thrown ball. Rotation, as depicted in FIG. 4 is facilitated by engagement of the socket (and specifically the front portion of the inside of the socket) with the resilient insert via the omitted area 201 on the front side of the shaft, and by engagement of the throat 12 (and specifically the back portion of the inside of the throat) with the resilient insert 210 via the notch 203. The resilient nature of the insert permits compression thereof at the front of the shaft thereby permitting the socket to move backward, and also permits compression of the insert at the back of the shaft thereby permitting the throat to move forward. The relative motion of the socket and throat (under the influence of the screw) results in a net rotation of the head and energy dissipation in the insert. The hardness and physical construction of the resilient insert (in terms of voids or holes 205) determines the amount of compression and thus resistance to rotation of the head provided by the insert 210 and thus the amount of rotation.

In this embodiment, the interaction of the inner surfaces of the socket and throat 12 not in contact with the resilient insert 210 are equally important. Because the inner throat 12 and socket surfaces fit tightly against the rigid material of the shaft 200 wall, as in a conventional lacrosse stick, the head 10 will not flex laterally or forward (i.e., in the direction that the lacrosse ball travels when it releases from a lacrosse stick) when a player cradles, shoots or passes the ball or is checked by an opponent. Unlike prior attempts in the art to create pocket "give" by altering the structure of the head 10, the present invention facilitates head movement or flex in only one direction and does not facilitate head movement in the opposite direction, a flex that would be undesirable to many players since it adds variability and inconsistency to ball handling which requires considerable precision. Thus, the upper portion of the encircling throat 12 is flush to and in contact with the rigid composite or metal portion of the shaft 200, as is the lower portion of the socket wall of the stop member 18, so as to resist undesirable flexing of the head relative to the shaft.

It should now be apparent that the above-described method and apparatus effectively dampens the rebound of a lacrosse ball received in a head 10 pocket in which the webbing is strung taught according to the rules of the game. Having now fully set forth the preferred embodiment and certain modifications of the concept underlying the present invention, various other embodiments as well as certain variations and modifications of the embodiments herein shown and described will obviously occur to those skilled in the art upon becoming familiar with said underlying concept. It is to be understood, therefore, that the invention may be practiced otherwise than as specifically set forth in the appended claims.

What is claimed is:

1. A lacrosse stick, comprising:

a tubular shaft having a top end for engagement with a head and further comprising a shaft wall having a first portion omitted on one side of said shaft, and having a second portion of said shaft wall omitted on an opposing side of said shaft and offset beneath said first portion;

a resilient insert within said tubular shaft proximal to said top end, said resilient insert extending lengthwise down the tubular shaft past said second omitted portion of said shaft wall; and a head comprising a pair of opposing sidewalls joined by a stop member having a socket for receiving a shaft, and a throat aligned with said socket such that said shaft passes through said throat when received in said socket; said socket engaging said resilient insert via said first omitted portion of said shaft wall and said throat engaging said resilient insert via said second omitted portion of said shaft wall when said top end of said shaft is seated in said socket;

whereby said head is permitted to rotate when a force applied to a front of said head and wherein said resilient insert is a tubular member.

2. The lacrosse stick of claim 1 wherein said first omitted portion of said shaft wall is open to said top end of said shaft.

3. The lacrosse stick of claim 2 wherein said first omitted portion of said shaft wall extends longitudinally a distance from 20 mm to 25 mm down the length of said shaft.

4. The lacrosse stick of claim 1 wherein said resilient insert has a durometer hardness of from 20 to 95 A.

5. The lacrosse stick of claim 4 wherein said resilient insert has a durometer hardness of from 35-50 A.

6. The lacrosse stick of claim 1 wherein said resilient insert further comprises at least one void therein for altering the weight or resilient properties of said insert.

7. The lacrosse stick of claim 6 wherein said at least one void extends longitudinally through said insert from one end to another end.

8. The lacrosse stick of claim 1 wherein the subtended angle of the arc formed by said first omitted portion of said shaft wall is from 80-degrees to 180-degrees.

9. The lacrosse stick of claim 8 wherein the subtended angle of the arc formed by said first omitted portion of said shaft wall is 90-degrees.

10. The lacrosse stick of claim 1 wherein the subtended angle of the arc formed by said second omitted portion of said shaft wall is from 80-degrees to 190-degrees.

11. The lacrosse stick of claim 10 wherein the subtended angle of the arc formed by said second omitted portion of said shaft wall is 180-degrees.

12. The lacrosse stick of claim 1 further comprising a fastener through said socket and into said back side of said shaft.

13. The lacrosse stick of claim 12 wherein said fastener is a screw.

14. The lacrosse stick of claim 1 wherein said second omitted portion of said shaft wall begins at a point from 10 mm to 30 mm along the length of the shaft and continues longitudinally for a distance from 35 mm to 50 mm.

15. The lacrosse stick of claim 1 wherein said resilient insert is from 55 mm to 90 mm in length.

16. The lacrosse stick of claim 1 wherein said resilient insert comprises a first portion having a first durometer hardness of from 20 to 95 A and a second portion having a second durometer hardness of from 20 to 95 A.

17. The lacrosse stick of claim 1 wherein said resilient insert comprises an exterior surface, said exterior surface contoured to fill the first omitted portion of said shaft wall and the second omitted portion of said shaft wall so as to be flush with an external surface of said shaft wall when inserted therein.

18. The lacrosse stick of claim 1 wherein said head is permitted to rotate toward said back side of said shaft about an axis perpendicular to said shaft by compression of said resilient insert on said front side of said shaft by said socket and on said back side of said shaft by said throat.

19. The lacrosse stick of claim 1 wherein said head further comprises a pocket between said side walls, said head rotating under the influence of a force applied to said pocket.

20. A lacrosse stick, comprising:

a shaft having a top end for engagement with a head, said shaft having a first portion of its cross section omitted on a front side of said shaft proximal to said top end, and having a second portion of its cross section omitted on a back side of said shaft;

a first tubular resilient member engaged within said first omitted cross section portion and contoured to replace said first omitted cross section portion; a second tubular resilient member engaged within said second omitted cross section portion and contoured to replace said second omitted cross section portion;

a head comprising a pair of opposing sidewalls joined by a stop member having a socket for receiving a shaft, and a throat aligned with said socket such that said shaft passes through said throat when received in said socket;

wherein said socket is aligned with first omitted cross section portion and engaged to said first resilient member and said throat is aligned with second omitted cross section portion and engaged with said second resilient member when said top end of said shaft is seated in said socket whereby compression of said resilient members permits rotation of said head when a force applied thereto.

* * * * *